US006457278B1

(12) United States Patent
Fleming

(10) Patent No.: US 6,457,278 B1
(45) Date of Patent: Oct. 1, 2002

(54) PIVOTAL DOORWAY FURNISHING

(76) Inventor: Craig H. Fleming, No. 1 Waterview Rd., Downingtown, PA (US) 19335

( * ) Notice: Subject to any disclaimer, the term of this patent is extended or adjusted under 35 U.S.C. 154(b) by 0 days.

(21) Appl. No.: 09/657,040

(22) Filed: Sep. 7, 2000

Related U.S. Application Data

(60) Provisional application No. 60/188,509, filed on Mar. 10, 2000.

(51) Int. Cl.[7] ..... A47L 3/00

(52) U.S. Cl. ..... 52/37; 52/36.1; 52/36.4; 52/36.5; 312/321.5; 312/326; 312/249.7

(58) Field of Search ..... 52/36.1, 36.4, 52/36.5, 37; 312/321.5, 326, 249.7, 249.2, 250, 237

(56) References Cited

U.S. PATENT DOCUMENTS

| | | | | |
|---|---|---|---|---|
| 767,232 | A | * | 8/1904 | McClung |
| 1,035,015 | A | | 8/1912 | Johnson |
| 1,731,746 | A | | 10/1929 | Hunter |
| 1,980,730 | A | | 11/1934 | Matchette |
| 2,200,934 | A | | 5/1940 | Platt |
| 2,701,384 | A | | 2/1955 | Barroero |
| 2,866,675 | A | | 12/1958 | Kesling |
| 3,662,493 | A | | 5/1972 | Foltz |
| 3,794,395 | A | * | 2/1974 | Damico et al. ..... 312/209 |
| 4,396,240 | A | * | 8/1983 | Henson ..... 312/237 |
| 4,478,467 | A | * | 10/1984 | Tyndall ..... 312/250 |
| 4,956,940 | A | | 9/1990 | Touton, III |

FOREIGN PATENT DOCUMENTS

| | | |
|---|---|---|
| FR | 745149 | 5/1933 |
| FR | 1060144 | 3/1954 |
| FR | 1371928 | 8/1964 |
| GB | 877022 | 1/1962 |

* cited by examiner

*Primary Examiner*—Beth A. Stephan
*Assistant Examiner*—Patrick J Chavez
(74) *Attorney, Agent, or Firm*—Laurence A. Weinberger

(57) ABSTRACT

Ingress and egress to closets and doorways through standard swinging doors requires that the area the door traverses be kept clear and is, therefore, space not usable for other purposes. The pivotal storage unit replaces doors with useful additional storage which occupies the full width and height of the door opening while permitting normal access through the doorway. The unit is mounted on hinges offset from the doorframe to permit full opening of the storage unit beyond 90°. The lower hinge incorporates a thrust bearing to support storage loads. A rolling support wheel on the base of the unit additionally supports the unit when heavily loaded. The unit can be formed in a variety of furniture configurations such as an armoire, computer work center, home entertainment center, pantry, desk, curio, vanity, etc. Two units can be used for double width doorways.

11 Claims, 12 Drawing Sheets

FIGURE 2
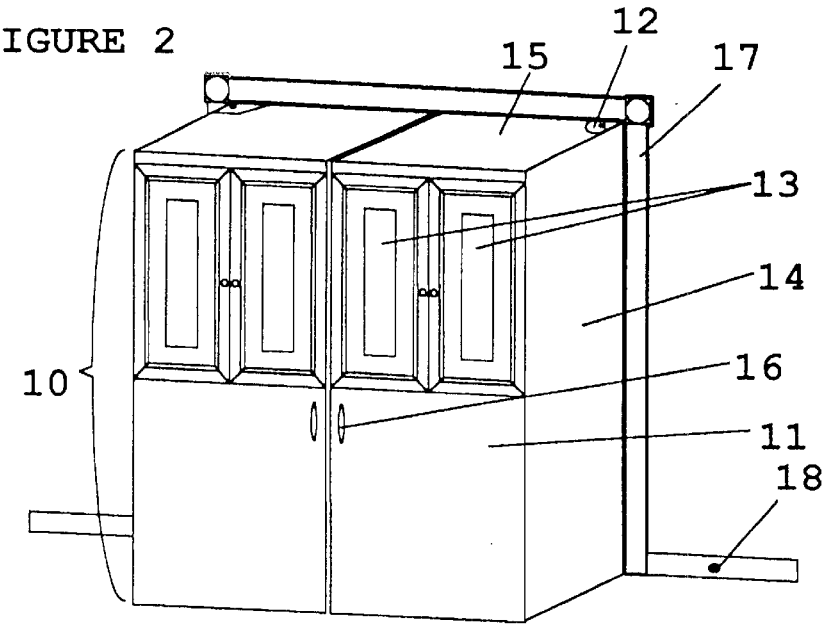
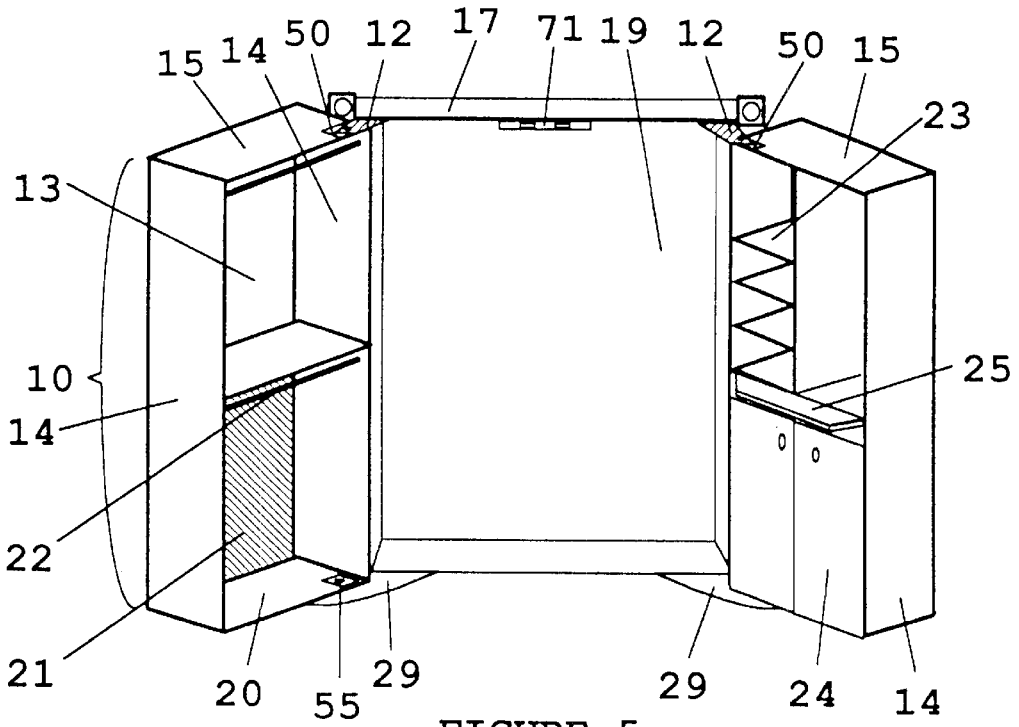
FIGURE 5

PIVOTAL DOORWAY FURNISHING

Benefit of U.S. Provisional Application No. 60/188,509 filed Mar. 10, 2000 is hereby claimed.

BACKGROUND OF THE INVENTION

1. Field of the Invention

This invention relates generally to furniture which may be installed to extend the storage and work space available in homes or offices, and more particularly to the utilization of the previously unused space in front of doorways which is typically preserved for the swinging arc of doors.

Most residences and business offices sooner or later run out of easily accessible storage and work areas. Additional storage or closet space is often required in residences and offices in response to the changing storage habits of individuals and businesses. In addition, easily accessible space in the home for computer stations, desks, home entertainment centers, pantries, vanities, etc. is frequently at a premium. Much of this additional space requirement can be met by the present invention.

2. Prior Art

Various storage devices are known in the prior art which are hinged and are intended to add additional storage space. However, not all features of the present invention are shown in the prior art either individually or in combination.

In U.S. Pat. No. 3,662,493, Foltz discloses a double acting pivot device for doors mounted between top and bottom pivots. While the patent discloses the use of a thrust bearing to support a load, the double action pivot is distinctly different from the hinge of the present invention. While Foltz discloses a thrust bearing, it is not designed to handle the higher loads of the present invention.

In U.S. Pat. No. 4,956,940, Touton discloses a floor supported offset door pivot in conjunction with an elongated threshold. The bottom pivot is the primary load-bearing pivot and typically includes a ball bearing for enhanced carrying capability. The pivot and threshold are designed to minimize the notching of the doorframe required for the installation of conventional hinges.

In U.S. Pat. No. 2,701,384, Barroero discloses a hinge assembly which can be used with refrigerated display case doors to support heavier loads while maintaining the cold seal. The invention utilizes bushing rather than a bearing of any kind.

In U.S. Pat. No. 2,866,675, Kesling teaches the use of a hinge and seal to enable the attachment and use of a refrigerator door to obtain additional cooled storage volume.

In French Patent No. 1,371,928, Marcu teaches a refrigerator door the contents of which can accessed through openings and doors on the outward surface of the door facing the kitchen.

In U.S. Pat. No. 1,731,746, Hunter teaches an extended closet storage compartment which is mounted onto the inside of a closet door and which extends into the interior closet space. Hunter's compartments provide segregated spaces for garments within the closet space defined by the, building construction. No new useful space is generated.

In U.S. Pat. No. 2,200,934, Platt et al teach a pivotally mounted storage structure which is mounted in a closet door frame opening. When open, the storage structure extends into the room adjacent to the closet. Like the Hunter device, Platt's structure occupies the interior space of the closet when it is in the closed position and does not extend outwardly to create additional storage. No new useful space is generated.

French Patent No. 745,149 discloses an armoire which can be mounted to an existing door. The unit is designed to primarily accept lightweight items of limited depth.

In U.S. Pat. No. 1,035,015, Johnson teaches the mounting of shelves and a glass display case to the outside of a hinged door.

In U.S. Pat. No. 1,980,730, Matchette discloses a storage compartment which can be hinged to any conventional entrance door for storing small items.

SUMMARY OF THE INVENTION

This invention relates to a furnishing, a pivotal storage/furniture unit, which may be located in doorways. The pivotal storage/furniture unit replaces a standard door and occupies the full width of a doorway opening and extends into the area normally used to provide access to the door and into which area the door swings when opened. Thus, storage volume is provided in an area that is normally not utilized because of access requirements for the doorway. In both the closed and open positions, the unit's storage volume may be accessed from either the front or rear side of the unit. In addition, offset top and bottom pivot hinges are employed so that the unit may be opened greater than 90°. The bottom hinge incorporates a thrust bearing to assist in load distribution. The weight of the pivotal doorway furnishing is further supported by the use of a support wheel which rolls upon a floor protector.

The invention may also be used in doorways between rooms as well as in entrances to storage areas such as closets. The functional features of the invention may be implemented in any number of furniture configurations embodying typical case goods (non-upholstered furniture) depending on the ultimate use desired. Thus, an armoire, wardrobe, computer work station, desk, home entertainment center, curio, vanity, and pantry are examples of case goods into which may be incorporated the functional features of the invention. The functional features of the invention may be employed in units which fit single, multiple, or larger door openings.

DESCRIPTION OF THE FIGURES

FIG. 2 shows a perspective view of two units of the present invention mounted on either side of a closet opening.

FIG. 5 shows a perspective view of two units of the present invention in an open position.

FIG. 6 shows the details of the bottom hinge assembly.

FIG. 7 shows the details of the top hinge assembly.

DESCRIPTION OF THE PREFERRED EMBODIMENT

Figure 1:
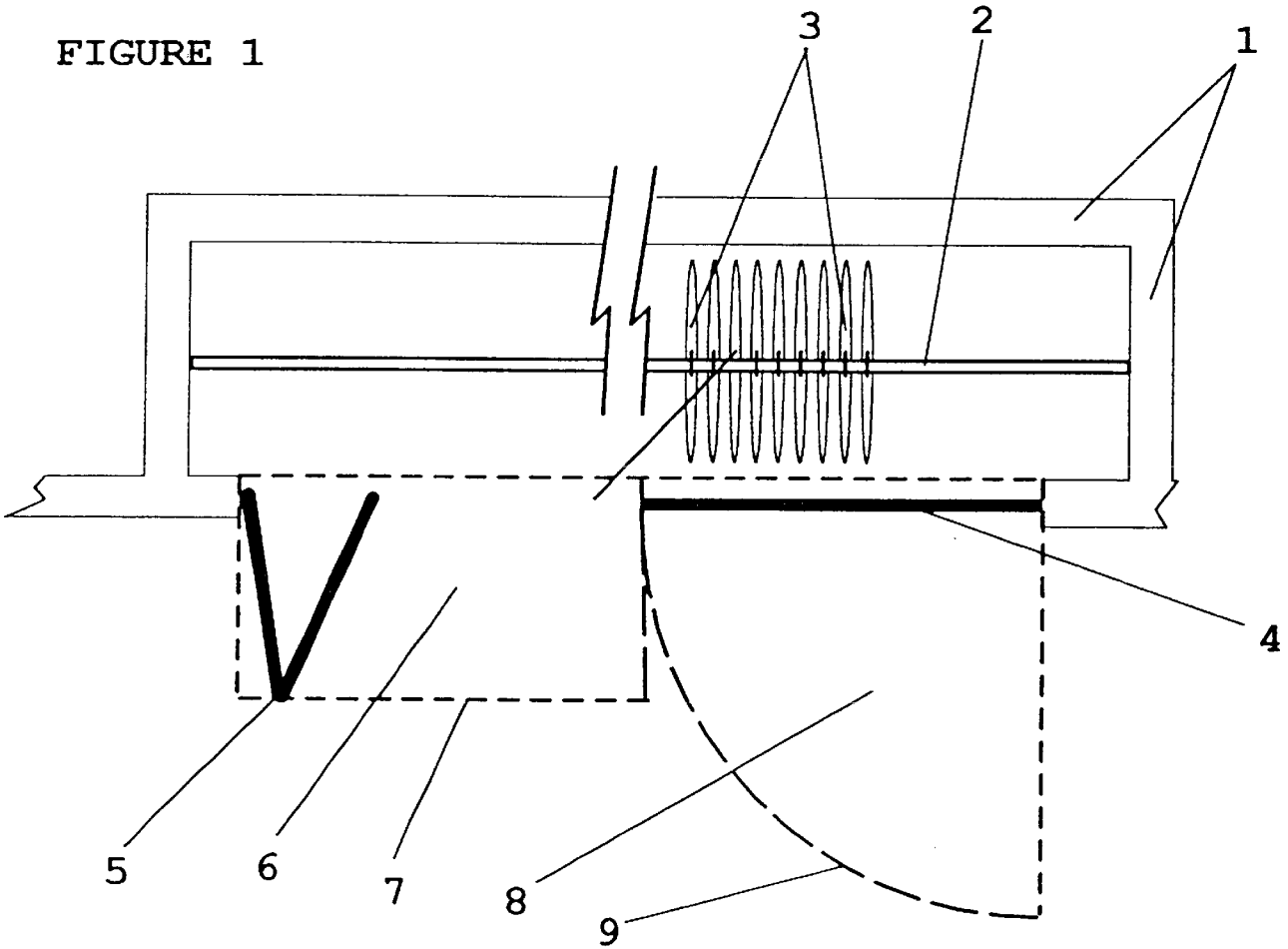
FIG. 1 shows a plan view of a typical conventional two-door closet.

Presently, doorways for most internal (no access to the outside) construction in the home or commercial and institutional buildings are fitted with conventional bi-fold, swinging, or sliding doors. Internal doorway structures primarily apply to doorways built for access to closets and adjacent rooms (in homes such access is also provided for basement or attic stairs). No article of furniture can be placed in this area as it is required for ingress and egress. The present invention allows for the placement of articles of furniture into existing internal doorways while still permitting ingress and egress. The invention design takes into account the standards and construction practices of the past and present. Most doors for internal purposes are of standardized height and width dimensions. Similarly the design of most doorway openings is standardized by applicable building codes. Taking into consideration the doorway construction standards, the invention is designed for application and use with these doorways. Since the design standards dictate the strength of the doorway opening, the invention can be applied to most properly constructed internal doorways. If a doorway is not properly constructed, reinforcing of the door jam and or horizontal joist may be necessary. A simple method of reinforcing the door jam is disclosed.

The minimization of volume needed for the structural integrity of the invention is paramount, because the invention must leave significant volume available for storage. For instance, the unit could be made of such heavy, strong, and rigid materials (such as is found in bank vault door constructions) that no additional support beyond that provided by the hinge points would be needed to prevent deflection of the unit due to the cantilevered loads. However, unlike those constructions known in the prior art, for a storage unit designed to fit in standard doorways, it is important to minimize the structural bulk of the unit in order to maximize the available storage volume. In addition, any unit designed to be mounted in standard doorway construction should not be so heavy that the forces generated by its mounting would seriously deform the doorway structure.

Thus, a key feature of the invention is its ability to provide a significant storage volume pivoted on an offset upper and lower hinge while still maintaining a rigid structural form without significant deflections or dimensional deformation. This feature is accomplished by meeting two principle design requirements. The first requirement is that the unit be substantially structurally rigid; that is, the unloaded unit will not readily deflect or deform when installed. Methods of making rigid structures are well known in the art. However, the structural components themselves should not add too great a weight to the structure. In the preferred embodiment of the invention, structural rigidity is accomplished through the use of structurally rigid components for the sides, top, bottom, and front (or equivalently, the back, depending on the furniture design into which the invention is incorporated, such as a pantry, home entertainment center, computer work center, etc.). The inventor has found that units built using standard woodworking assembly techniques, well known in the art, and using plywood and oak provides sufficient rigidity. Clearly, any material which provides sufficient rigidity (such as modern composite materials) would also meet the requirements.

A second requirement arises because the load (weight) resulting from both the structural material and the items placed upon/within the unit will subject the unit to significant cantilevered forces and moment forces. The configuration of the invention and location of the hinge pivot points is such that the unit will be subject to torsion loads (twisting) resulting from the cantilevered forces. For relatively narrow doorways such as may be found in linen closets, the rigidity of the construction material may be sufficient to resist deformation/twisting from the cantilevered forces. However, for standard access doorway widths, deformation in excess of that which can be resisted by the rigidity of the construction material may occur. In units constructed according to the teachings of this patent document, the deformation is counter-acted by the rigid panel design and the use of an additional support point some distance from the hinge pivot point. This support point could itself be mounted in the ceiling above the unit and attached by suitable means to the unit, but, in the preferred embodiment, a support wheel is mounted to the bottom of the unit. The support wheel is designed to counteract torsion or cantilevered force deflection and unit deformation. The wheel rests upon a smooth hard floor protector. The location of the support wheel under the bottom of the unit permits its presence to be substantially hidden from view. In addition, the wheel is positioned so that its radius of tracking falls totally within the area defined by the unit when the unit is closed. Thus, the floor protector only needs to cover this same area and, therefore, may also be substantially hidden from view when the unit is closed. The floor protector is composed of a material suitable to withstand the force exerted by the support wheel with out showing significant wear over time. The floor protector is also designed not to be visible when the unit is closed and is of sufficient surface area to distribute the load exerted by the unit through the support wheel. This distribution of the load is particularly important over carpeting or wood flooring which would be subject to wear over time from the radial movement of the support wheel. All these requirements are met by the design of the preferred embodiment of the invention, as set out herein.

The following description sets forth the critical design features required for the invention. The materials used in construction of the storage unit will dictate the methods by which the pieces of the unit are attached to each other. In the preferred embodiment, standard woodworking techniques of fastening and construction can be used to make the unit from plywood and oak. Referring to the drawings, FIG. 1 shows a plan view of a typical conventional two-door closet. The closet walls 1 support a closet hanger rod 2 from which hang clothing hangers 3. A conventional swing to open closet door 4 is shown on one side of a closet door opening with a radius of opening indicated by line 9 requiring an area of space 8 which provides for egress and ingress to the closet. Shown on the other side of the closet door opening are typical bi-fold doors 5 which require area 6 defined by 7 for opening and closing. Areas 6 and 8 are normally unusable for storage since they must be kept clear to access the closet. This previously unusable space is the area utilized for storage by the present invention.

FIG. 2 shows a perspective view of two units 10 of the present invention mounted on either side of the closet opening. Units 10 are shown in the closed position. A single unit 10 would be used for a single width door opening and could be mounted on either side of the opening. In the furnishing configuration shown, the outward facing front side 11 has two doors 13 for access to the top portion of unit 10 and a handle 16 for opening the entire unit. The unit also consists of a top 15, two sides 14 (innermost side 14 not shown in this view) and a bottom 20 (not shown in this view). Offset hinges facilitate the opening of the entire unit beyond a 90° angle to the wall. A top cantilevered hinge assembly 12 mounts to top 15 while a corresponding bottom hinge assembly 55 (not shown in this view) is fastened to bottom 20. Doorway opening molding 17 is shown across the closet opening. Bumper 18 prevents damage to the floor molding or wall when unit 10 is in the open position.

Figure 3:
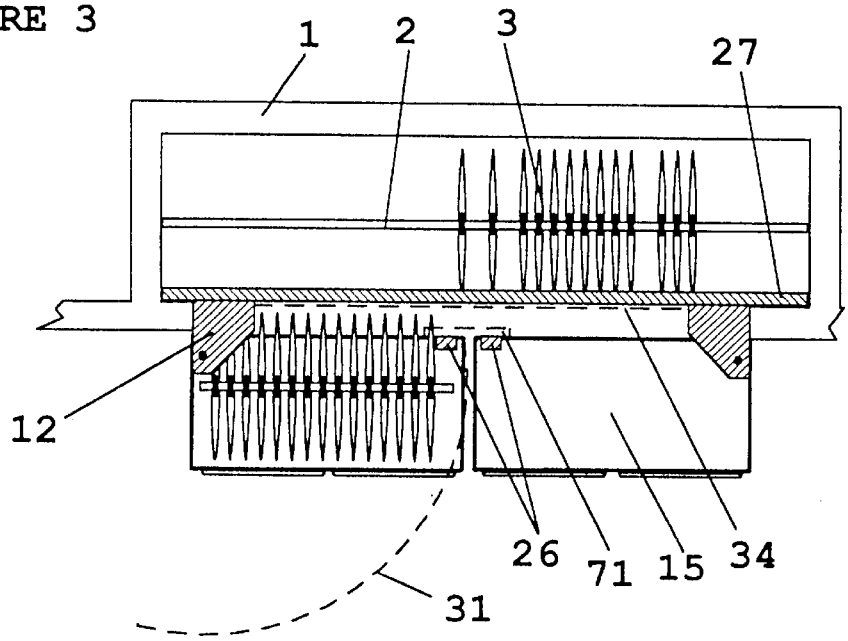
FIG. 3 shows a plan view of two units of the present invention in a closed position.

FIG. 3 shows the plan or overhead view of two units 10 in the closed position. Line 31 shows the radius of opening for the left-hand side unit 10. Magnetic latches 26 secure the unit in the closed position by latching to metal latch plate 71 which is secured to the doorway header. If the doorway is not properly constructed and can not adequately support the moment applied by the weight of unit 10, the door jam may be reinforced with a rigid reinforcing bar 27 placed on the inside of the closet door opening adjacent to the closet door opening header. Line 34 represents the depth limit of the usable storage area which extends into the door jam area. Hangers or other items located in unit 10 may extend into this area since it is no longer needed for access doors. Line 31 represents the swinging arc of unit 10 when it is opened.

Figure 4:
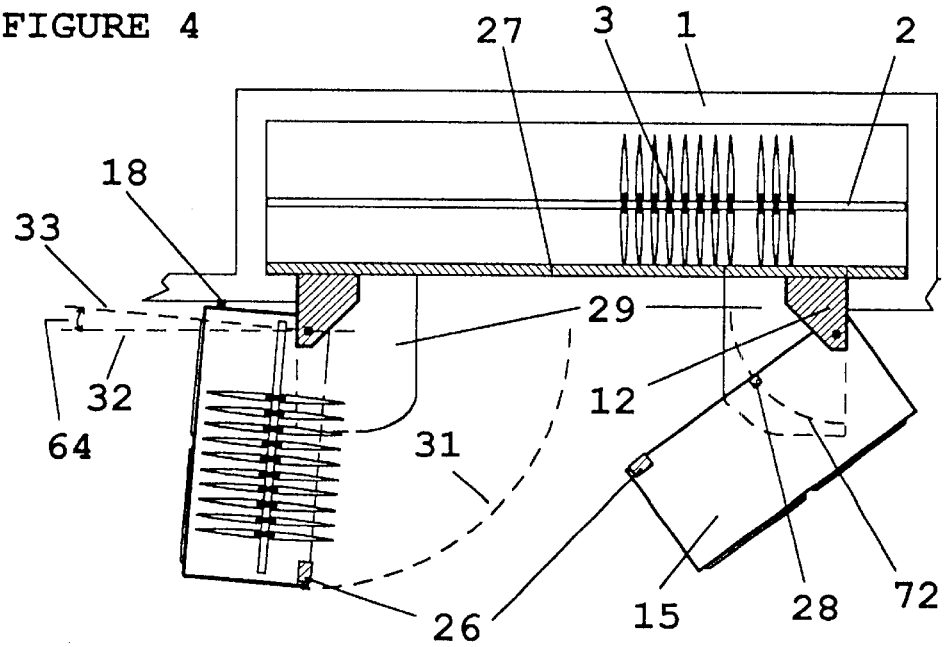
FIG. 4 shows a plan view of two units of the present invention in an open position.

FIG. 4 shows the plan or overhead view of two units 10 in an open position. The left-hand unit 10 is shown fully open while the right hand unit 10 is shown only partially open. A floor protector 29 having a depth corresponding to the depth of unit 10 is located underneath the bottom 20 of unit 10 and is only visible when the unit is open. Floor protector 29 is fastened to the floor underneath unit 10. On the right hand unit 10, support wheel 28 is shown located on the bottom of the unit. Support wheel 28 rests upon floor protector 29 and further supports unit 10. Floor protector 29 prevents wear to the floor or carpeted floor from support wheel 28. Line 72 denotes the tracking radius for support wheel 28 which radius lies within the area of floor protector 29. Line 32 is shown parallel to the wall while line 33 is parallel to the outermost side 14 of unit 10 when unit 10 is in the full open position. Due to the offset location of the top 12 and bottom 55 hinges, unit 10 will open more than 90 degrees so that there is a small angle 64 formed.

FIG. 5 shows a perspective view of two units 10 in an open position. The closet area 19 is fully accessible when units 10 are in an open position. Units 10 can be designed with many different storage configurations as are well known in the art. For instance, it may be provided with assorted shelves 23 or clothes hanger rods 22. The unit may also be equipped with internal cabinets 24. Shelves 25 may also extend into the door jam area, since this area is no longer needed for the traditional doors. A unit top fastener plate 50 is installed on the top of unit 10 as part of the top hinge assembly 12. As can be appreciated by those skilled in the art, cantilevered loads may cause deflections. To prevent deflection or torsion of unit 10 from cantilevered loads, unit 10 is provided with stiffening panel 21.

FIGS. 6A, 6B, 6C, and 6D show the detail of bottom hinge assembly 55. A bearing sleeve 58 is fastened to the unit bottom lower fastening plate 57, typically by welding. In the preferred embodiment, for maximum strength, bearing sleeve 58 is welded into a hole cut through unit bottom lower fastening plate 57. One end 80 of bearing sleeve 58 is flush with one surface 81 of plate 57. Plate 57 rests against the underside of the bottom 20 of unit 10. Bearing sleeve 58 is sufficiently long to pass through hole 79 in bottom 20. Unit bottom upper fastening plate 56 has a hole 84 sufficient to accommodate the outer diameter of bearing sleeve 58. One end 77 of bearing sleeve 58 is flush with the top surface 78 of plate 56. Plates 56 and 57 and bottom 20 have corresponding holes 85 and 86 such that bolts 59 may be passed through plate 57, through bottom 20, and through plate 56 and fastened securely with nuts and washers 54.

Floor plate bottom hinge pin 62 is welded to floor plate 61. In the preferred embodiment, for maximum strength, hinge pin 62 is welded into a hole cut through floor plate 61. Floor plate spacer 63 provides the proper clearance to insure both proper engagement of hinge pin 62 with bearing sleeve 58 and proper positioning and alignment for support wheel 28 so that the unit is properly leveled. Floor plate spacer 63 and floor protector 29 have holes corresponding to mounting holes 87 in floor plate 61. Floor plate 61 is mounted to floor 65 with floor plate spacer 63 and floor protector 29 in place with fasteners 66, typically lag bolts, which pass through holes 87. Floor protector 29 is installed between the floor spacer and the floor. Bottom hinge assembly 55 is aligned with the top hinge assembly 12 such that unit 10 is properly positioned.

Figure 6A:
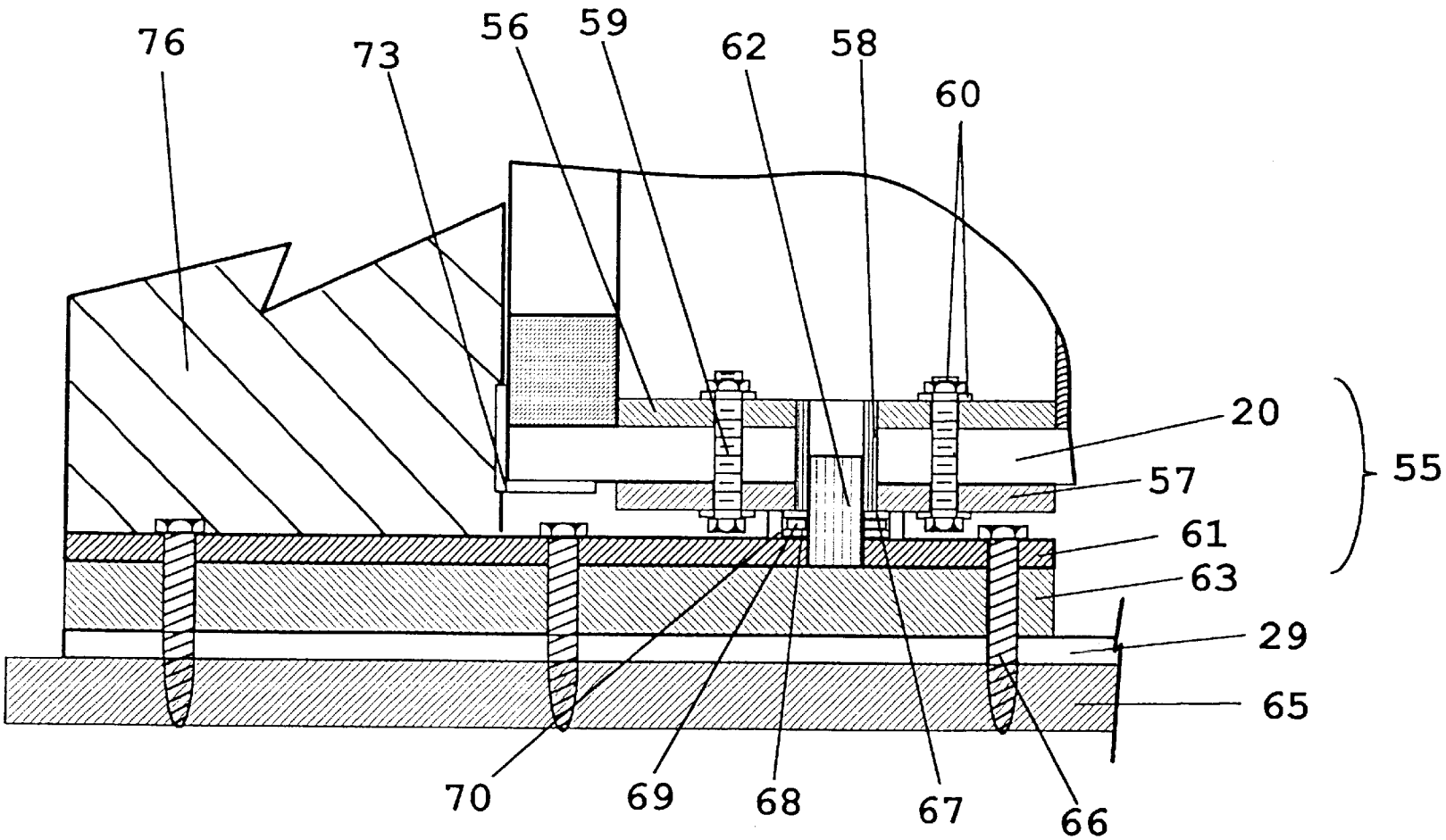
FIG. 6A shows the hinge assembly as mounted to the unit and floor.
Figure 6B:
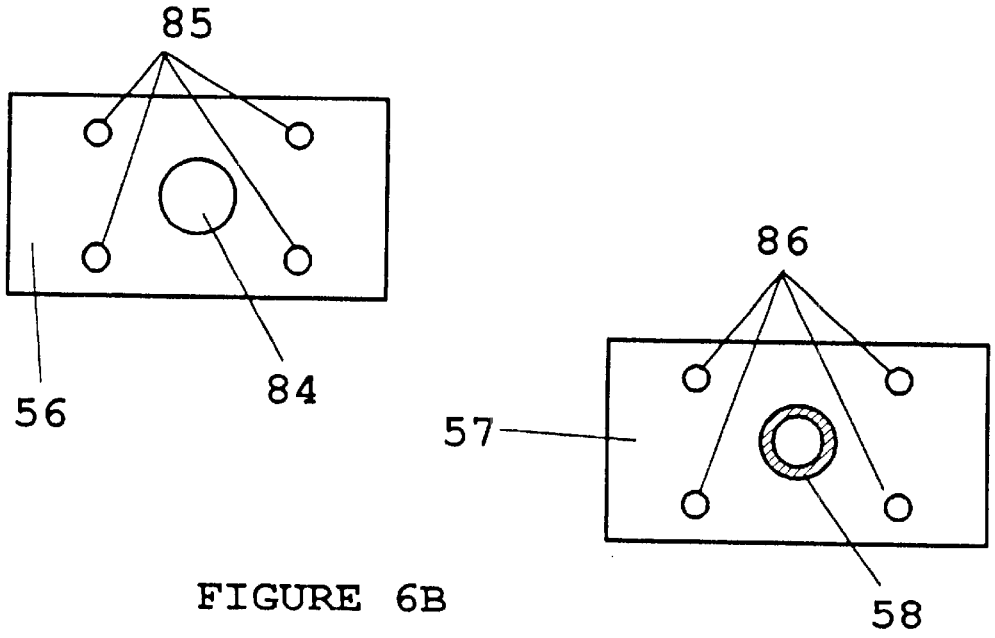
FIG. 6B shows detail of the upper and lower unit bottom fastening plates.
Figure 6C:
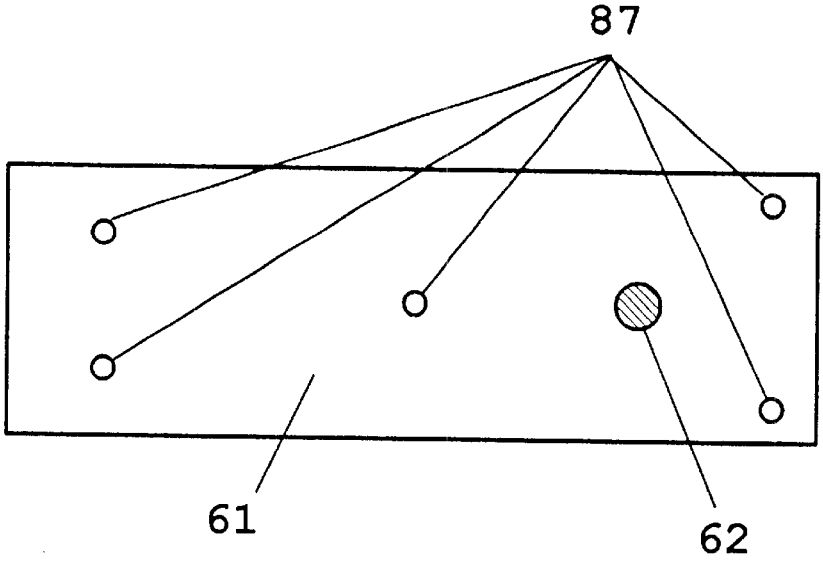
FIG. 6C shows detail of the floor plate.
Figure 6D:
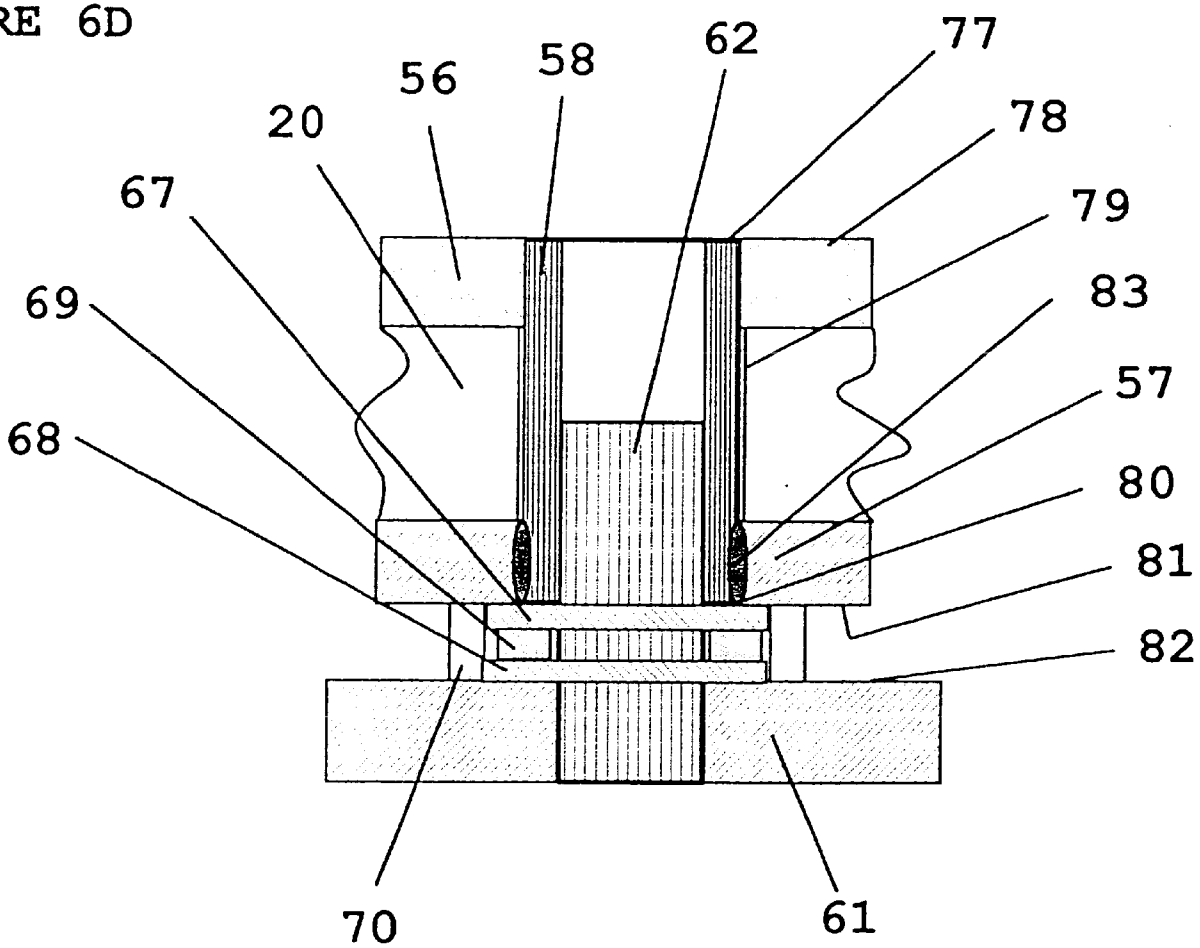
FIG. 6D shows detail of the thrust bearing assembly.

As can be seen more clearly in FIG. 6D, bottom thrust washer 68 fits over hinge pin 62 and rests on the upper surface 82 of floor plate 61. Trust bearing 69 fits over hinge pin 62 and sits on top of bottom thrust washer 68. Top thrust washer 67 fits over hinge pin 62 and sits on top of thrust bearing 69. In the preferred embodiment, thrust bearing 69 is of roller bearing design. Dust shield 70 is placed around thrust bearing 69 and washers 67 and 68 to prevent dust infiltration to reduce bearing wear. Unit 10 with the upper 56 and lower 57 fastening plates in place, is installed so that bearing sleeve 58 fits over floor plate bottom hinge pin 62, and rests upon upper thrust washer 67. Structural angle 73 is installed to the rear edge of bottom 20 of unit 10 when support wheel 28 is required.

Figure 7A:
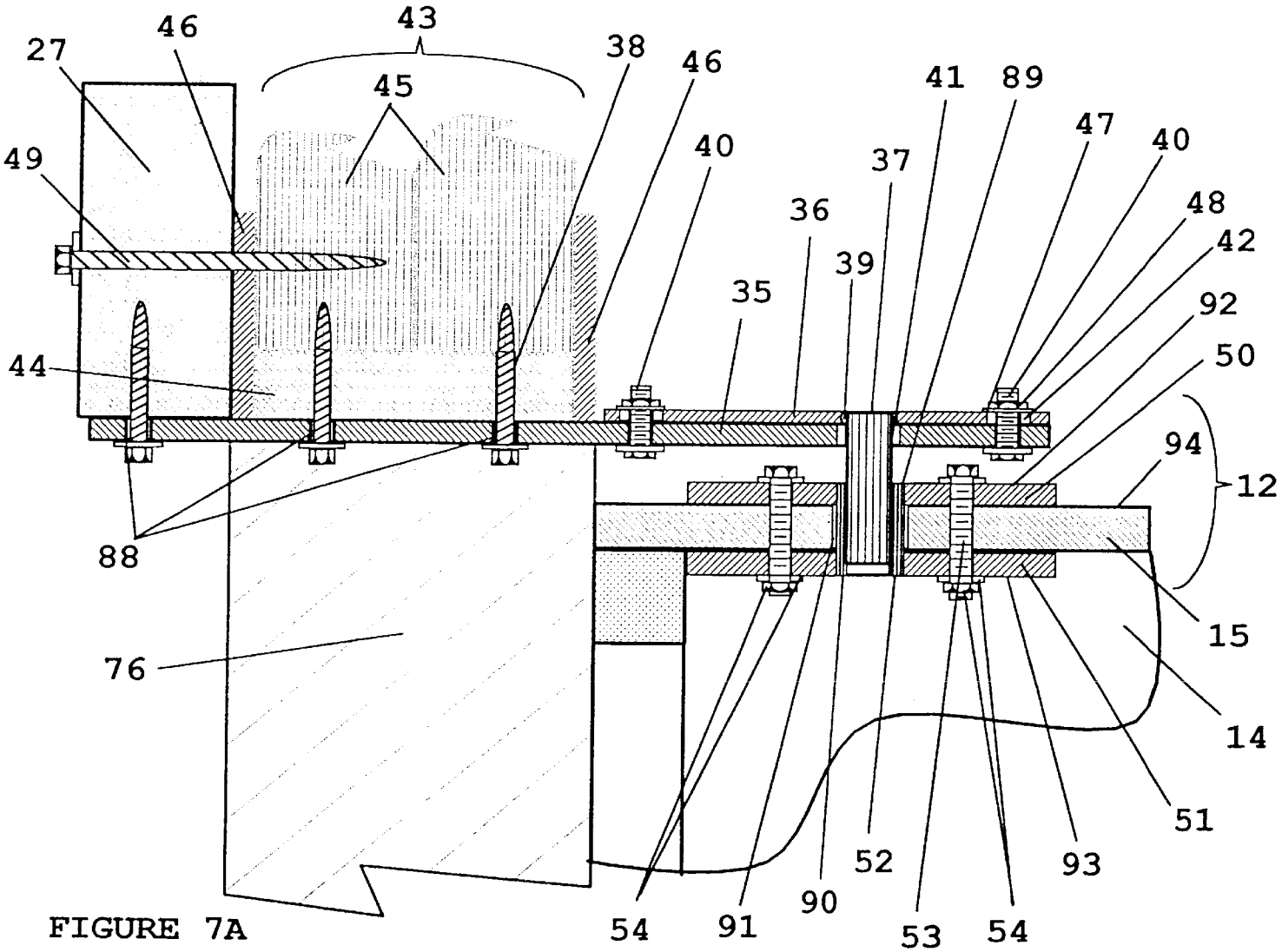
FIG. 7A shows the top hinge assembly mounted to a doorway header and a storage unit.
Figure 7B:
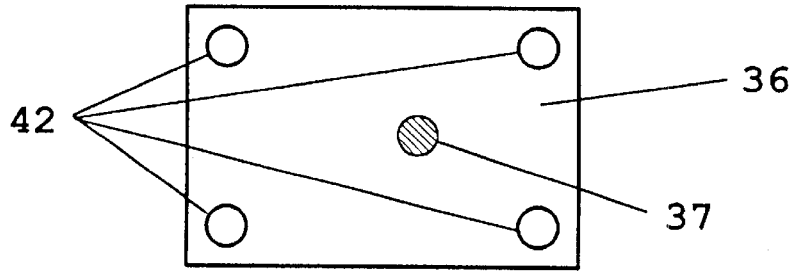
FIG. 7B shows detail of the top hinge extension mounting plate.
Figure 7C:
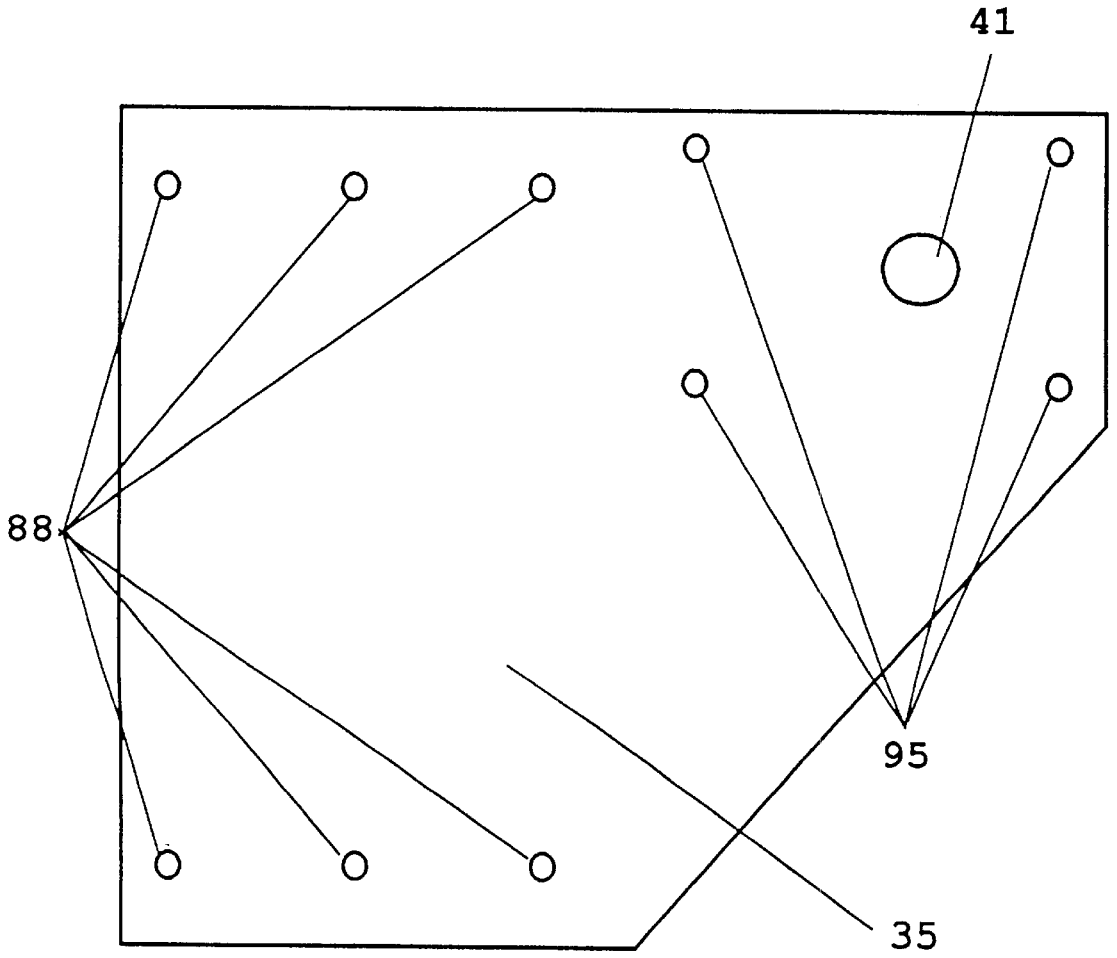
FIG. 7C shows details of the top hinge extension plate.

FIG. 7 shows top hinge assembly 12 fastened to the vertical door face 76. The typical construction of a door opening joist assembly is denoted by 43. Typically according to building codes, the joist assembly consists of two joists 45, and a joist header facing 44. The joist assembly is finished on the visible surfaces with wall or gypsum board 46 and plaster. When unit 10 is to be heavily loaded and the door jam or horizontal joist are not properly constructed, it may be necessary to install a reinforcing member or bar 27. Reinforcing member 27 may be installed to the joist assembly with lag bolts 49.

FIG. 7 also shows the detail of top hinge assembly 12. Top hinge extension plate 35 is mounted to joist assembly 43 (and reinforcing bar 27 where required) with fasteners 38, typically lag bolts, which pass through holes 88 in top hinge extension plate 35. Top hinge pin 37 is secured by weld 39 to top hinge extension plate 36. In the preferred embodiment, for maximum strength, hinge pin 37 is welded into a hole cut through top hinge extension mounting plate 36. Top hinge extension plate 35 has a hole 41 with a diameter larger than the diameter of top hinge pin 37. When hinge pin 37 is placed through hole 41 so that top hinge extension mounting plate 36 rests on top hinge extension plate 35, plate 36 may be moved to provide final adjustment, alignment, and leveling of unit 10 during installation. For the same reason, top hinge extension mounting plate 35 has oversized bolt holes 42. Top hinge extension plate 35 has holes 95 corresponding to the centered spacing of holes 42 in plate 36. Bolts 40 pass through holes 95 in plate 35 then through holes 42 in plate 36 and are securely fastened with washers 47 and nuts 48.

A top fastening plate assembly is formed in a manner identical to the upper 56 and lower 57 bottom fastening plates. A bearing sleeve 52 is fastened to, typically by welding, and passes through unit top upper fastening plate 50. One end 89 of bearing sleeve 52 is flush with one surface 92 of plate 50. Plate 50 rests against the top surface 94 of top 15 of unit 10. Bearing sleeve 52 is sufficiently long to pass through hole 91 in top 15. Unit top lower fastening plate 51 has a hole sufficient to accommodate the outer diameter of bearing sleeve 52. One end 90 of bearing sleeve 52 is even with one surface 93 of plate 51. Plates 50 and 51 and top 15 have corresponding holes such that bolts 53 may be passed through plate 50, through top 15, and through plate 51 and fastened securely with nuts and washers 54. Clearly, for both the top and bottom unit fastening plate assemblies, the bearing sleeve may be fastened to either plate.

For installation, the top and bottom hinge pins should be vertically in line as is well understood in the art. Unit 10 is positioned by first placing unit 10 over the bottom hinge assembly 55. With unit 10 in a substantially vertical position with bearing sleeve 52 aligned with hole 41 in hinge plate extension 35, top hinge pin 37 is inserted through top hinge extension mounting plate 35 into bearing sleeve 52. Unit 10 is leveled, and washers 47 and nuts 48 are placed on bolts 40 and tightly secured to hold unit 10 in place.

Figure 8:
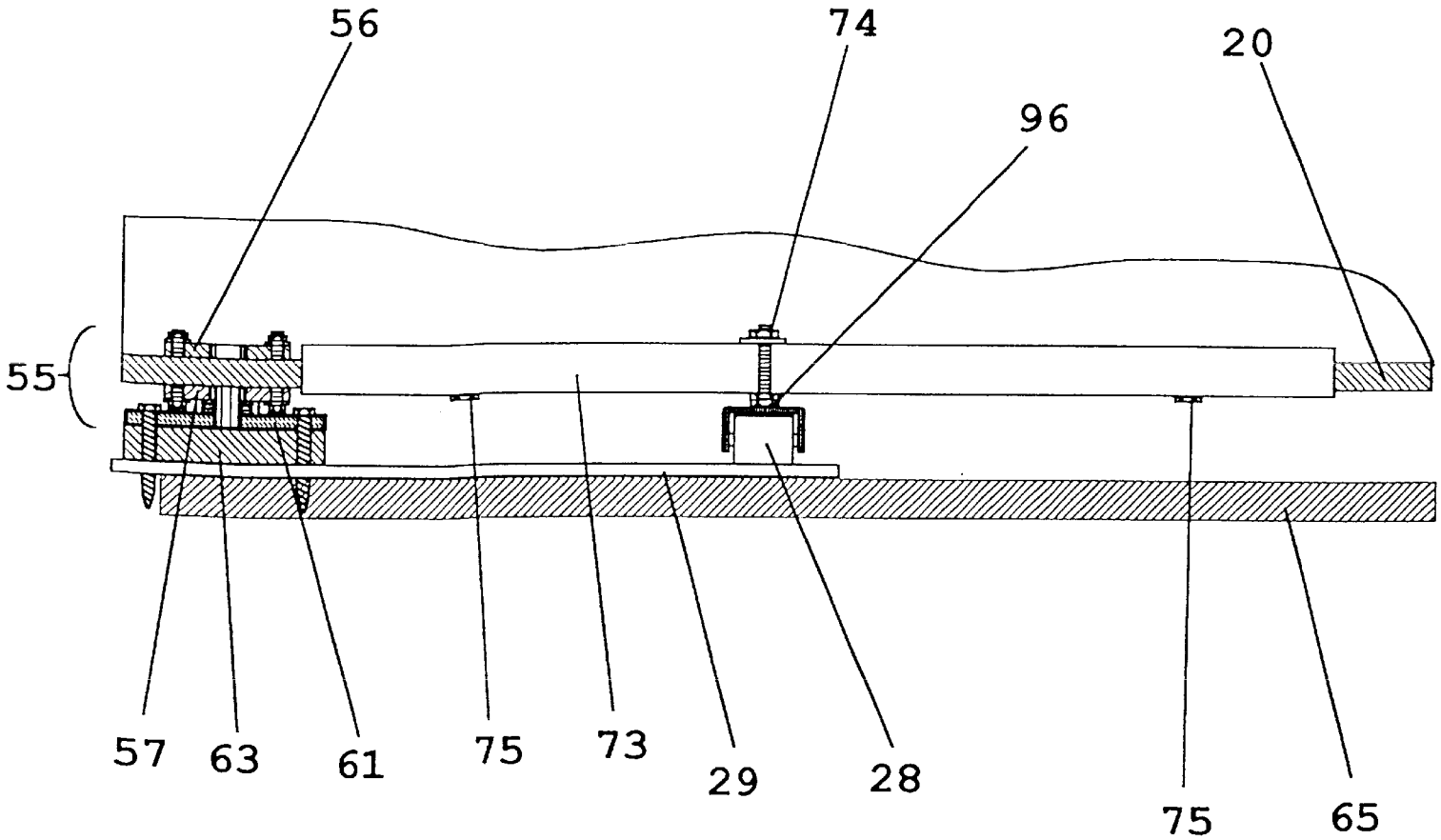
FIG. 8 shows a back view of the bottom portion of the unit.

FIG. 8 shows a back view of the bottom portion of unit 10. This view shows the position of bottom hinge assembly 55. For those applications which require support wheel 28, angle support 73 may be installed along the lowermost edge of bottom 20 to reinforce unit bottom 20. Angle support 73 is composed of a sufficiently strong material having a high modulus of elasticity. Angle support 73 is secured to bottom 20 with fasteners 75. Support wheel 28, prevents deflection of unit 10 due to twisting from a cantilevered load. Support wheel 28 is installed through angle support 73 and bottom 20 and is secured with support wheel fastener 74. Support wheel 28 can be adjusted with nuts 96 so that wheel 28 firmly rests on floor protector 29, which is fastened to the floor. Floor protector 29 can be installed over any floor surface including carpeting.

Figure 9:
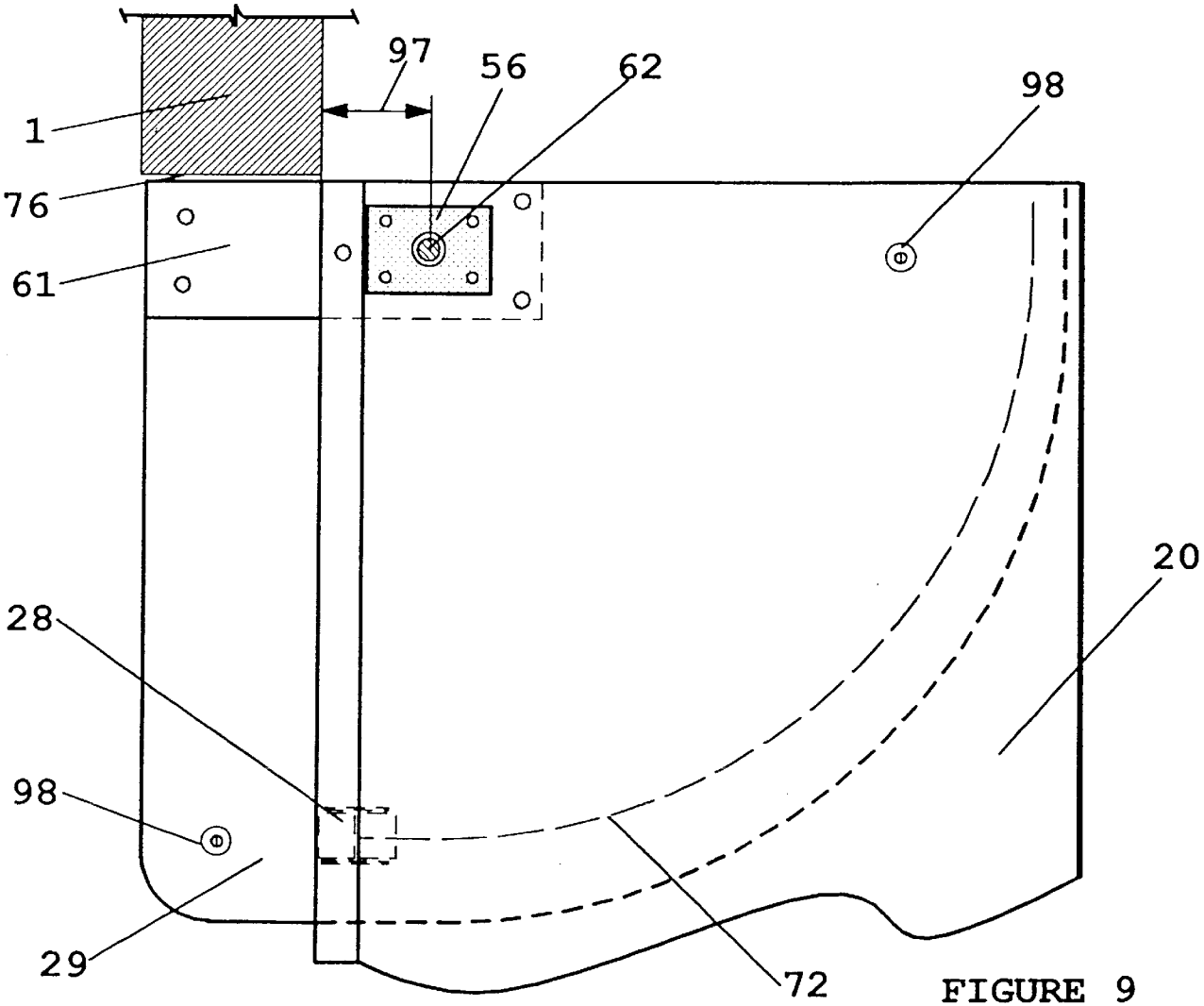
FIG. 9 shows a top view of the bottom portion of the unit.

FIG. 9 shows a top view of bottom 20 of unit 10. The location of floor protector 29, floor plate 61, and unit bottom upper fastening plate 56 are shown in relationship to closet wall 1 vertical door face 76. Line 72 shows the radius of tracking for support wheel 28. Support wheel 28 and floor protector plate 29 are not substantially visible when unit 10 is in the closed position. As can be seen, the position of hinge pin 62 and, thus, the hinge pivot point, is located away from wall 1 a hinge pivot offset dimension 97, thereby permitting unit 10 to swing open more than 90 degrees. Top hinge pin 37 is similarly located. The exact distance out. from the door face may be varied for a single unit according to the desires of the manufacturer. For a single unit, the distance governs how far beyond 90° the unit will open. However, for a double installation where two units 10 are to be mounted across a double door opening, the distance 97 at which the pivot may be located out from the door face is a function of the distance between the interior sides of the units when the units are in a closed position. As the distance out from the door face increases, the swinging arc of each unit requires that the distance or gap between the units in the closed position be greater so that the units do not hit each other as they are swung open. In the preferred embodiment, the gap is minimized for aesthetic appearance to about one inch so that the units appear to be substantially contiguous. The distance of the hinge axis from the wall must therefore be kept correspondingly smaller. These considerations are well understood by those skilled in the mounting of doors.

Figure 10:
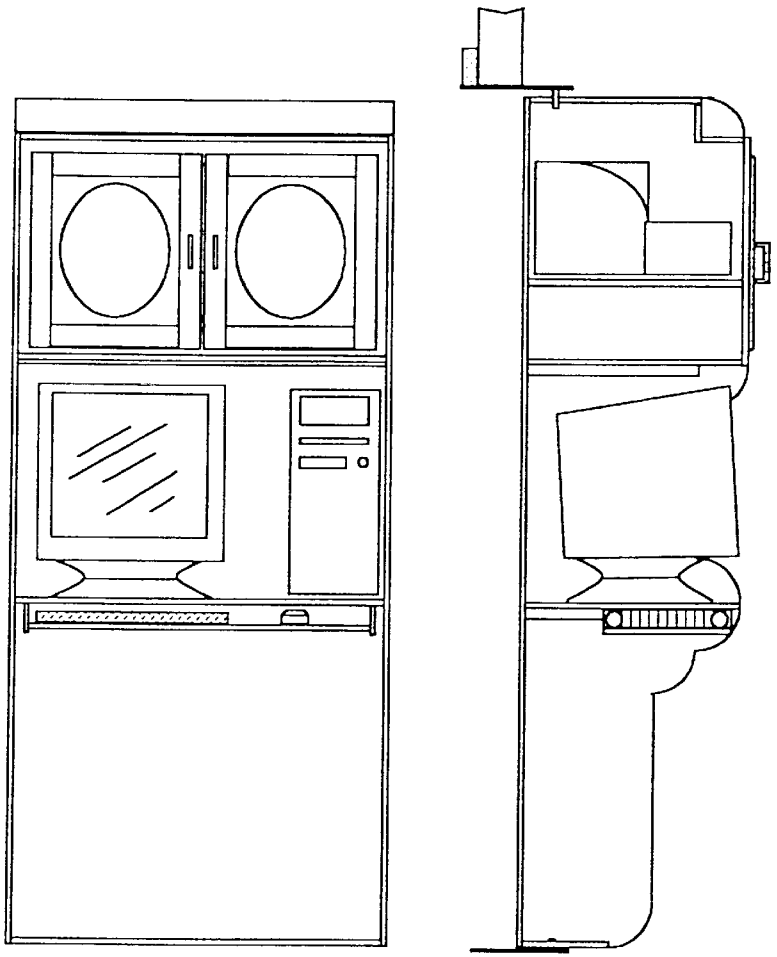
FIG. 10 shows an embodiment of the present invention in the form of a computer workstation which provides access from the side of the unit which protrudes or is open to the room into which the unit pivots.
Figure 11:
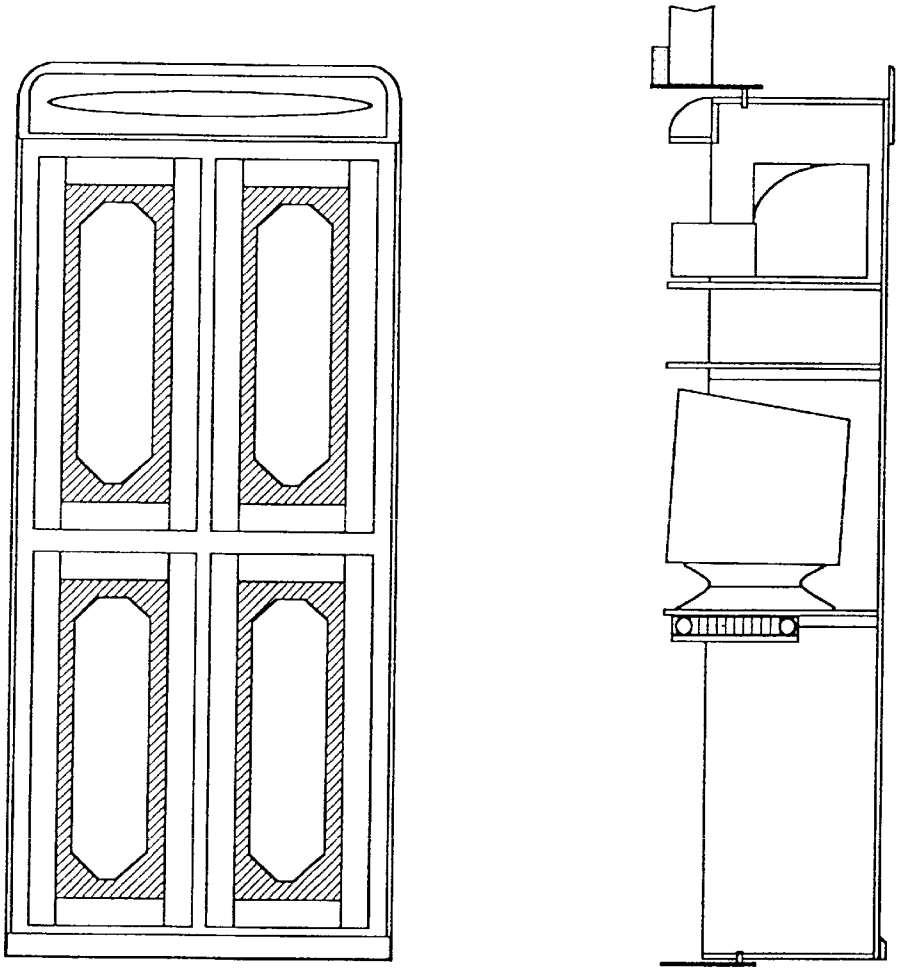
FIG. 11 shows an embodiment of the present invention in the form of a computer work station which is accessed either by opening it into the room into which the unit pivots or is accessed from the rear side when the unit is in a closed position.

FIGS. 10 and 11 show alternative furniture designs for the pivotal doorway furnishing. FIG. 10 shows a computer work center design, which is accessible from the room side when unit 10 is in the closed position. FIG. 11 shows a computer workstation design that is only accessible when unit 10 is opened. Thus, when unit 10 is closed, an aesthetically designed panel is all that is visible to the room. Pivotal doorway furnishings are applicable to the following designs and applications among others: armoire, computer work center, home entertainment center, pantry, desk, curio, vanity, workbench, etc.

Each of the units's front, side, and end panels are designed to insure rigidity of the unit, thus minimizing deflection under load. The design of the unit is such that conventional style doors are either not mounted or are removed from a doorway prior to installation of the unit. The unit is a reinforced structure which occupies the space, which until now has been unusable for reasons of access. The pivotal doorway furnishing comprises a pivotal structure such that it will rotate about a pivot point located in such a fashion so as to permit opening slightly more than 90 degrees from the front of the doorway opening.

The cantilevered top hinge serves as a stabilizing pivot and its pivotal axis is mounted directly above the floor hinge pivot axis. Ease of opening is facilitated in the bottom hinge through use of a thrust roller bearing installed between the floor mounting plate and the rotatable pivotal doorway furnishing structure. The thrust bearing permits the unit to be easily rotated to the open position. The floor mounted support plate is not visible from the exterior room side of the unit when the unit is closed. Thus, the unit appears to anyone in the room as just another piece of furniture mounted against the wall. The trim normally found around a doorway may be removed and the walls treated so as to make the appearance of the unit as a piece of furniture against a bare wall more complete.

The design of the invention provides for the proper support of the cantilevered loads which will be present in the unit. A front rigid panel 21 properly secured to the side panels of the pivotal doorway furnishing will prevent misalignment and vertical deflection. For narrow doorways (such as linen closets), the rigidity of the construction material may be sufficient to resist deformation/twisting from the cantilevered forces. However, when the unit is used with wider doorway openings, a support wheel may be mounted on the underside of the unit to transfer the weight of the unit to the floor, thus preventing deformation. To prevent depression of any carpeting and to provide a smooth surface for the wheel, a floor protector plate may be placed on the flooring or carpet. Support wheel 28 is placed along the bottom of the unit so that the floor protecting plate upon which the wheel rides does not extend beyond the front of the storage unit when the unit is in the closed position.

Additionally, reinforcement of the existing door jam and horizontal joist may be necessary. In a typical installation, the reinforcement is accomplished by installing a 2"33 4"board 27 running the full length of the top horizontal portion of the door jam on the inside of the door.

Finally, it should be noted, that the design of the invention permits use of the space within the doorframe normally occupied by the door to be used as functional storage space. Interior partitions within the pivotal doorway furnishing shown in the Figures are not structural and my be arranged in any manner of configurations. The invention is secured in a closed position with conventional latching mechanisms.

In addition to providing additional storage space, the pivotal doorway furnishing design can accommodate almost an unlimited variation in the design of the furniture into which it is incorporated. Access to the interior spaces of the unit may be from just one side or, alternatively, may be simultaneously provided from each side. Other applications for the units of this invention are between rooms (e.g., between a living room and dining room) where it may be desirable to place an article of furniture and still permit use of the doorway. For instance, instead of having solid sides, the top and bottom may be attached to load bearing rods and/or cables or similar arrangements and combinations thereof.

Those skilled in the art will recognize that various modifications, additions, substitutions, and variations to the invention as described herein can be made without departing from the spirit of the invention and are, therefore, considered within the scope of the invention.

I claim:

1. A storage unit for mounting to a building structure opening in a wall comprising:

a. a storage unit having a substantially rectangular cross-section providing at least a top, two sides, and a bottom;

b. a cantilevered upper hinge comprising:
1) a member attached to the building;
2) a hinge pin mounted to the member attached to the building;
3) a member attached to the storage unit top; and
4) a means of attaching the two members for leveling the storage unit;

c. an offset lower hinge comprising:
1) a member attached to a floor of a building;
2) a hinge pin mounted to the member attached to a floor of the building;
3) a member attached to the bottom of the storage unit adapted to support the weight of the storage unit; and
4) thrust bearing means wherein the hinge pins are vertically aligned with respect to the storage unit and are offset away from the wall towards the side of the opening on which the storage unit is installed.

2. The storage unit of claim 1 further comprising a support wheel attached to the storage unit bottom.

3. The storage unit of claim 2 further comprising a floor protector mounted on the floor wherein the support wheel travels on the floor protector.

4. The storage unit of claim 1 further comprising a front comprised of one or more movable members adapted to provide access to the contents of the storage unit when the storage unit is not in its fully open position relative to the building structure on which it is mounted.

5. The storage unit of claim 1 wherein the building structure to which the storage unit is attached is a doorframe.

6. A method of utilizing for storage the space adjacent to a doorway opening in a building wall through which one or more doors swing comprising:

a. providing a storage unit having a substantially rectangular cross section including at least a top, two sides, and a bottom;

b. providing a cantilevered upper hinge comprising:
1) a member attached to the building;
2) a hinge pin mounted to the member attached to the building;
3) a member attached to the storage unit top; and
4) a means of attaching the two members for leveling the storage unit;

c. providing an offset lower hinge comprising:
1) a member attached to a floor of a building;
2) a hinge pin mounted to the member attached to a floor of the building;
3) a member attached to the bottom of the storage unit adapted to support the weight of the storage unit; and
4) thrust bearing means wherein the hinge pins are vertically aligned with respect to the storage unit and are offset away from the wall towards the side of the opening on which the storage unit is installed.

7. A storage unit for mounting in a doorframe opening in a building wall which utilizes for storage the space otherwise necessary for swinging clearance of a door comprising:

a. a storage unit having a substantially rectangular cross-section providing at least a top, two sides, and a bottom;

b. a cantilevered upper hinge comprising:
1) a member attached to a doorframe;
2) a hinge pin mounted to the member attached to a doorframe;
3) a member attached to the storage unit top; and
4) a means of attaching the two members for leveling the storage unit;

c. an offset lower hinge comprising:
1) a member attached to a floor;
2) a hinge pin mounted to the member attached to the floor;
3) a member attached to the bottom of the storage unit adapted to support the weight of the storage unit; and
4) thrust bearing means wherein the hinge pins are vertically aligned with respect to the unit and are offset away from the wall towards the side of the doorframe opening on which the storage unit is installed.

8. The storage unit of claim 7 further comprising a support wheel attached to the storage unit bottom.

9. The storage unit of claim 8 further comprising a floor protector mounted on the floor wherein the support wheel travels on the floor protector.

10. The storage unit of claim 7 further comprising a front comprised of one or more movable members adapted to provide access to the contents of the storage unit when the storage unit is not in its fully open position relative to the doorway in which it is mounted.

11. A method of utilizing for storage the space through which one or more doors, attached to a doorframe opening in a building wall, would swing comprising:

a. providing a storage unit having a substantially rectangular cross section including at least a top, two sides, and a bottom;

b. providing a cantilevered upper hinge comprising:
1) a member attached to the building;
2) a hinge pin providing mounted to the member attached to a building;
3) a member attached to the storage unit top; and
4) a means of attaching the two members for leveling the storage unit;

c. providing an offset lower hinge comprising:
1) a member attached to a floor of a building;
2) a hinge pin mounted to the member attached to a floor of the building;
3) a member attached to the bottom of the storage unit adapted to support the weight of the storage unit; and
4) thrust bearing means wherein the hinge pins are vertically aligned with respect to the storage unit and are offset away from the wall towards the side of the doorframe opening on which the storage unit is installed.

* * * * *